United States Patent [19]

Hilt et al.

[11] 4,396,168

[45] Aug. 2, 1983

[54] MULTIPLE PACKAGE THREAD TRANSFER ALIGNMENT GUIDE SYSTEM

[75] Inventors: Darlene C. Hilt, Richmond; Robert Z. Schreffler, Chester, both of Va.

[73] Assignee: Allied Corporation, Morris Township, Morris County, N.J.

[21] Appl. No.: 237,771

[22] Filed: Feb. 24, 1981

[51] Int. Cl.[3] ..... B65H 49/02; D03J 5/08

[52] U.S. Cl. ..... 242/130; 242/157 R

[58] Field of Search ..... 242/128, 130, 131, 153, 242/157 R, 157 C, 167, 171; 226/195, 196; 57/352, 901, 58.36, 58.83

[56] References Cited

U.S. PATENT DOCUMENTS

| | | | |
|---|---|---|---|
| 2,370,731 | 3/1945 | Jackson | 242/157 R |
| 2,437,539 | 3/1948 | King | 87/57 |
| 2,460,366 | 2/1949 | Seeman | 242/157 R |
| 2,842,323 | 7/1958 | Rayburn | 242/128 |
| 3,307,805 | 3/1967 | Verbeek | 242/129.8 |
| 3,428,269 | 2/1969 | Horwood et al. | 242/128 |
| 3,821,543 | 6/1974 | Gelin et al. | 242/157 R |
| 4,114,829 | 9/1978 | Boehler | 242/157 R |

*Primary Examiner*—Leonard D. Christian

*Attorney, Agent, or Firm*—Richard A. Anderson

[57] ABSTRACT

A multiple package thread transfer alignment guide system for continuously feeding thread from multiple supply sources to a processing location under controlled tension conditions is disclosed. A thread transfer alignment guide device, including first and second eyelet openings interconnected by a tortuous path, is positioned in close proximity to the generally horizontally mounted supply packages and aligns the thread to enter a trumpet guide. Each eyelet opening is substantially aligned with the longitudinal feed axis of a corresponding supply package. The tortuous path means includes first and second rod portions spaced apart from each other and in overlapping relation to define a path inlet opening communicating with each of the eyelets. When the thread transfer is to occur from the first eyelet opening to the second eyelet opening, a momentary loss of balloon thread tension is experienced, together with a growing effect of tension along the new thread path vector angle. This change in thread tension allows the thread to enter the tortuous path from the first eyelet opening, traverse the tortuous path and enter the second eyelet opening for continuous feed. With this device, thread tension of approximately 7 to 9 grams is maintained resulting in less thread breakage and minimal loss of production time.

11 Claims, 8 Drawing Figures

Fig. 5
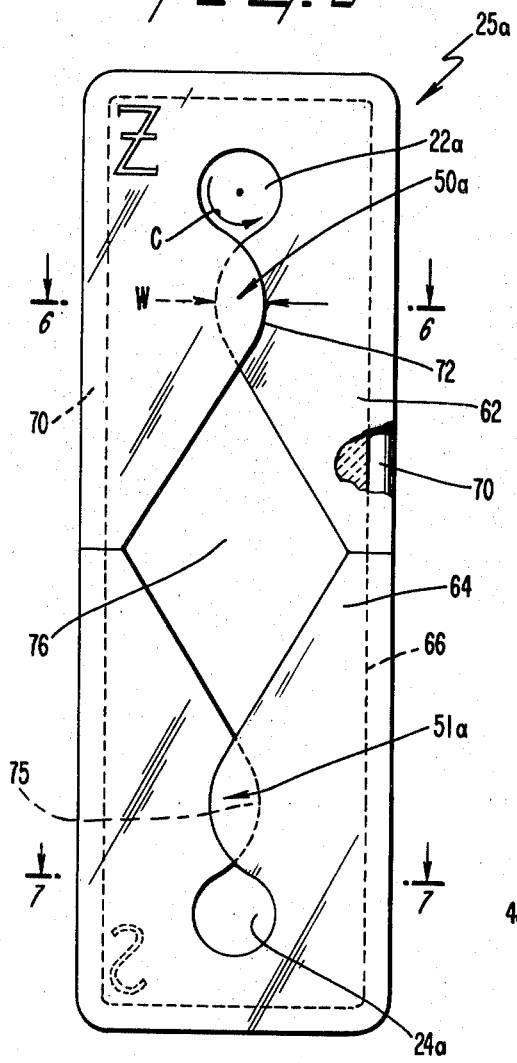
Fig. 3
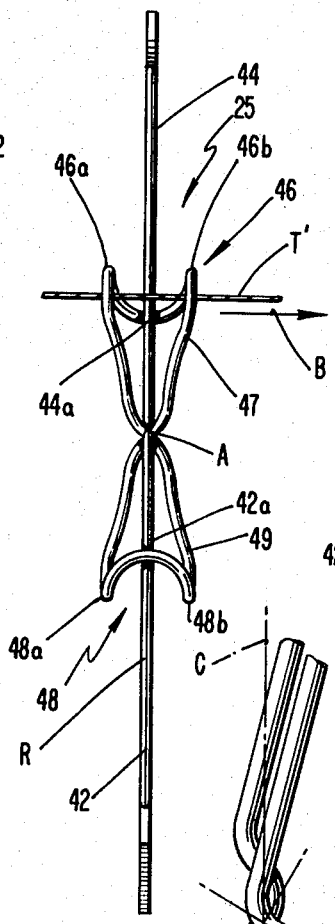
Fig. 4
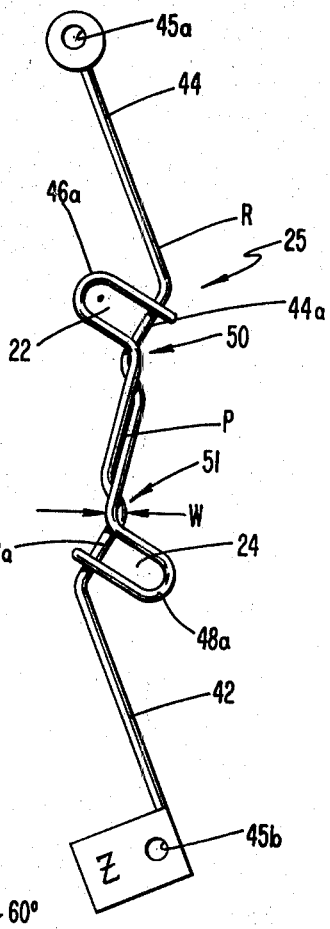
Fig. 4a
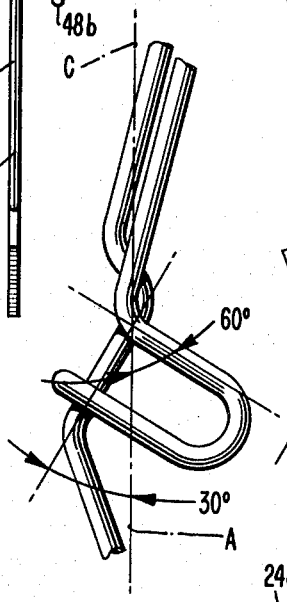
Fig. 6
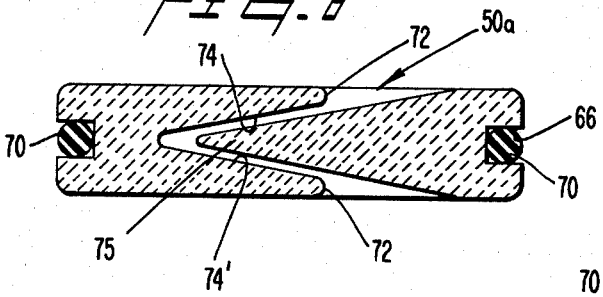
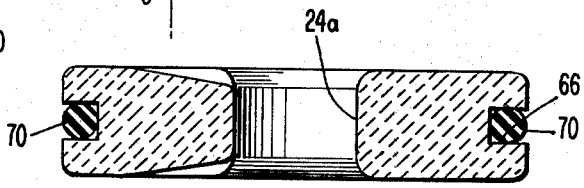
Fig. 1

MULTIPLE PACKAGE THREAD TRANSFER ALIGNMENT GUIDE SYSTEM

TECHNICAL FIELD

This invention generally relates to thread transfer alignment guides, and more particularly, to a thread guide system capable of transferring a thread between an emptying supply package to a full thread supply package while maintaining thread alignment and minimizing tension fluctuations during transferring and feeding.

BACKGROUND ART

Carbon treated nylon and synthetic polymer yarns are employed in some carpet manufacturing processes for imparting anti-static properties to multi-filament carpet yarn. This anti-static yarn is usually blended into a carpet yarn containing 50 to over 200 filaments in each yarn end or bundle. This blending operation occurs on a yarn processing panel.

The anti-static yarn is usually monofilament, or includes only a few filaments of small denier (6–20), and can be fragile and easily broken. Consequently, the anti-static yarn must be treated gently until blended into the protection of the multi-filament carpet yarn.

A prior method and apparatus for blending the anti-static yarn to the carpet yarn includes a vertical package arrangement for continuous feed, as illustrated in FIG. 1 of the drawing. As shown in FIG. 1, two supply packages containing fragile, anti-static yarn or thread are aligned for feeding yarn into a vertically oriented first trumpet guide, positioned a distance of approximately 11 inches from the supply packages. After passing through the trumpet guide the thread passes around a roller and becomes horizontally oriented before passing through a lost-end-detector and second trumpet guide into a processing panel. The distance between the first trumpet guide and lost-end-detector is approximately 7 inches. As the thread supply of the first spool depletes, a new thread supply from a second spool begins feeding thread into the first trumpet guide, at a different thread supply angle. Due to the fragile qualities of the anti-static yarn, the first trumpet guide is positioned an appreciable distance from the supply packages, to minimize the thread supply path and excessive tension fluctuations that might otherwise result in yarn breakage by closer positioning.

In this prior art arrangement, the anti-static yarn is tensioned within the range of 20 to 25 grams, and because of its fragile qualities, breakage does occasionally occur. Such tension is generally attributable to the roller turn required of the thread for proper alignment with the yarn processing panel. However, the vertical trumpet guide/roller arrangement has heretofore been necessary to properly control the "ballooning effect" resulting in increased tension fluctuations experienced as the yarn feeds off the spool in a rapid manner.

Each time thread breakage occurs, the processing panel is shut down by the lost-end-detector and must be manually strung up by an operator, resulting in lost production time, yarn waste and other inefficiencies.

DISCLOSURE OF INVENTION

It is accordingly an object of the present invention to provide a multiple package thread transfer alignment guide system capable of minimizing and controlling yarn or thread tension and lessen thread breakage.

Another object of the invention is to provide a thread transfer alignment guide system capable of reliable operation with minimal loss of production time.

Still another object is to provide a thread transfer alignment guide capable of reducing the thread path feed angle and minimizing thread ballooning effect.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

A multiple package thread transfer alignment guide system, in accordance with the present invention, is capable of feeding yarn or thread stored on supply packages to a processing panel and minimizing and controlling thread tension to lessen thread breakage. The alignment guide system includes first and second horizontally positioned supply packages wherein thread stored on one of the supply packages is spliced to thread of an adjacent package for effecting continuous feed off of the second package when the first package thread supply is exhausted. Thread from the first supply package passes through a first eyelet opening of a thread transfer alignment guide and thereafter through a single eyelet opening of a trumpet guide aligned to blend the anti-static yarn with carpet yarn on a processing panel. The eyelet opening of the thread transfer alignment guide is substantially aligned with the longitudinal feed axis from the first supply package to minimize the thread feed angle, thus lessening thread tension and minimizing breakage. As the thread supply of the first package is exhausted, a momentary loss of tension together with a growing effect of tension along the new thread path vector angle is operative to cause thread passing through the first eyelet opening to enter a tortuous path transferring the thread to a second eyelet opening aligned with the thread feed axis from the second supply package.

The thread transfer alignment guide of the present invention may be formed from a continuous rod shaped to define the first and second eyelets and the tortuous path separating the eyelets. The tortuous path includes first and second portions spaced apart from each other in overlapping relation to define a path inlet opening communicating with each of the eyelets. The first portion of each path inlet opening includes two corresponding arcuately shaped rod portions spaced apart from each other, and a second portion includes an opposing arcuately shaped rod portion intermediate and spaced apart from the first portions in overlapping relation. These portions overlap a predetermined distance in a direction substantially coplanar with the eyelet openings. Preferably, the first portion forms an angle of approximately 30° with the longitudinal axis of the path and the second portion forms a complementary angle of substantially 60° with the axis. This arrangement is operative to laterally confine the thread within the first eyelet opening during thread feed from the first supply package, and yet is operative to successfully allow transfer of the thread to the second eyelet opening when the change to the spliced-in new thread supply is initiated.

In an alternative embodiment, a thread transfer alignment guide may be formed from a material of unitary structure shaped to define respective first and second eyelets and a tortuous path connecting the eyelets. A first portion of the path includes two corresponding arcuately shaped portions defining a channel having a channel axis leading into the eyelet opening. The second portion includes an opposing arcuately shaped portion projecting into the channel and spaced apart from the first portions. Preferably, first and second eyelets and corresponding tortuous path inlet openings are formed in complementary inserts. A groove is formed peripherally extending around each insert. Each insert is retained by a rectangular frame structure interfitted in the grooves to define the alignment guide of the present invention.

BRIEF DESCRIPTION OF DRAWINGS

FIG. 3 is a plan or side view of the thread transfer alignment guide formed according to the present invention and formed of a continuous shaped rod;

FIG. 4 is a front view of the guide shown in FIG. 3, illustrating first and second eyelets and a tortuous transfer path therebetween;

FIG. 4*a* is an enlarged detail showing one eyelet including the axis of the transfer path opening;

FIG. 5 is a front view of an alternative thread transfer alignment guide formed of a solid material;

FIG. 6 is a detailed cross-sectional view taken along the line 6—6 of FIG. 5, illustrating the tortuous path inlet opening defined by first and second overlapping portions; and FIG. 7 is a detailed cross-sectional view taken along the line 7—7 of FIG. 5, illustrating communication of the eyelet opening and tortuous path inlet opening.

BEST MODE FOR CARRYING OUT THE INVENTION

Figure 1:
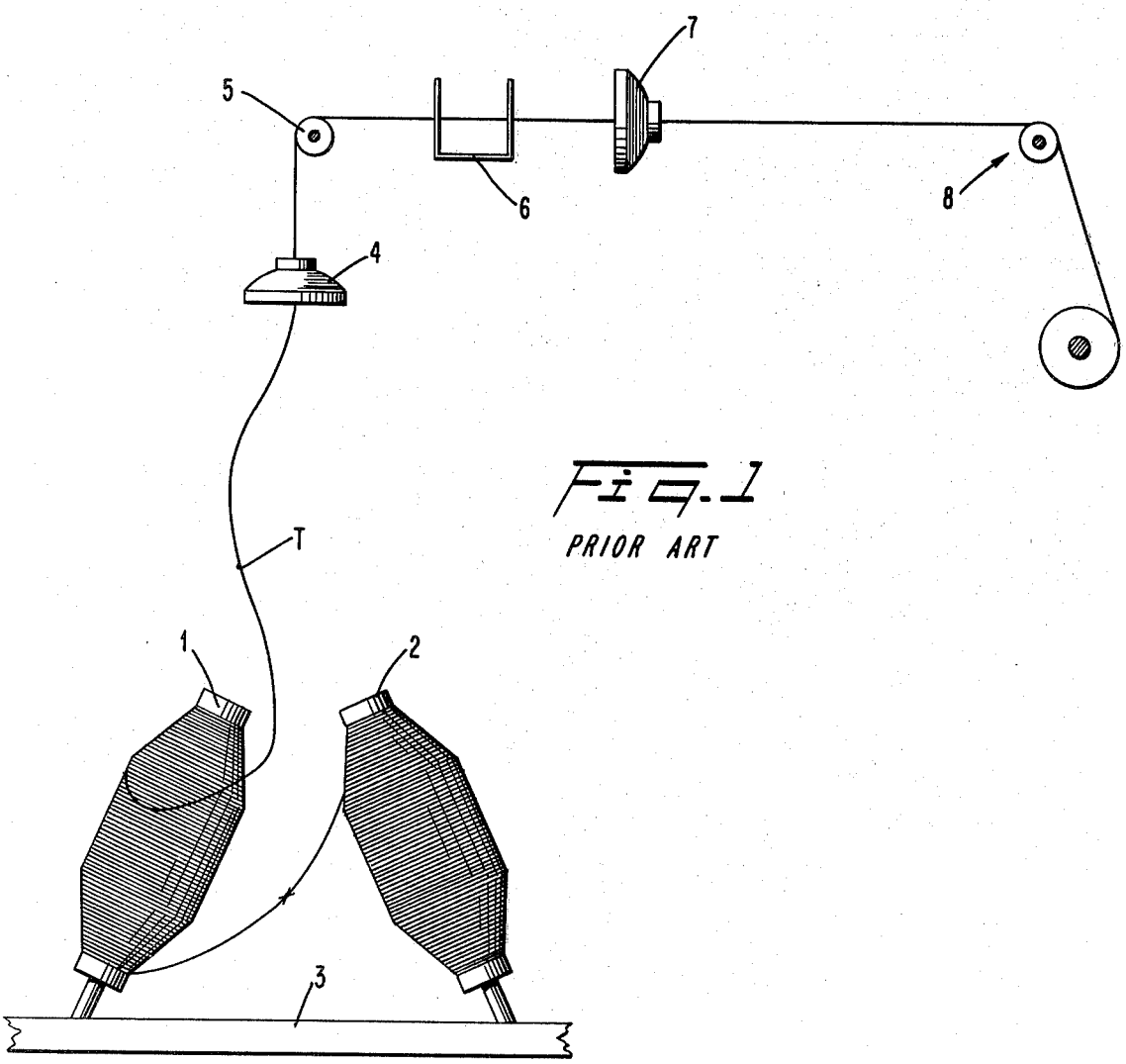
Fig. 1 PRIOR ART
FIG. 1 is a schematic view which illustrates a prior art vertical package arrangement for continuously feeding thread into a processing panel, requiring a roller turn, plus a vertical trumpet guide in order to control thread ballooning.

Reference will now be made in detail to the present preferred embodiment of the invention, an example of which is indicated in the accompanying drawing. As discussed above, FIG. 1 illustrates a prior method and apparatus for feeding fragile anti-static thread T into a processing panel, wherein relatively high tension (20–25 grams) is exerted upon the thread by the uncontrolled ballooning and the vertical guide/roller mechanism 5. With such devices, elimination of the roller to lessen thread tension is feasible only when the supply creel 3 feed path is horizontally aligned with trumpet guides 4 and/or 7. However, such a proposed horizontal arrangement lends itself to other problems. For example, by positioning supply packages 1, 2 horizontally and in alignment with trumpet guide 4 (arrangement not shown), the ballooning effect of thread T "spinning off" supply package 1 may inadvertently cause the thread to wrap around supply package 2 and break. While this problem could be attenuated by positioning trumpet guide 4 in closer proximity to the supply packages to minimize ballooning, or, alternatively, increasing the separation distance between the packages, either of the arrangements would increase the thread supply angle, thereby increasing tension exerted upon thread T and also result in breakage.

Figure 2:
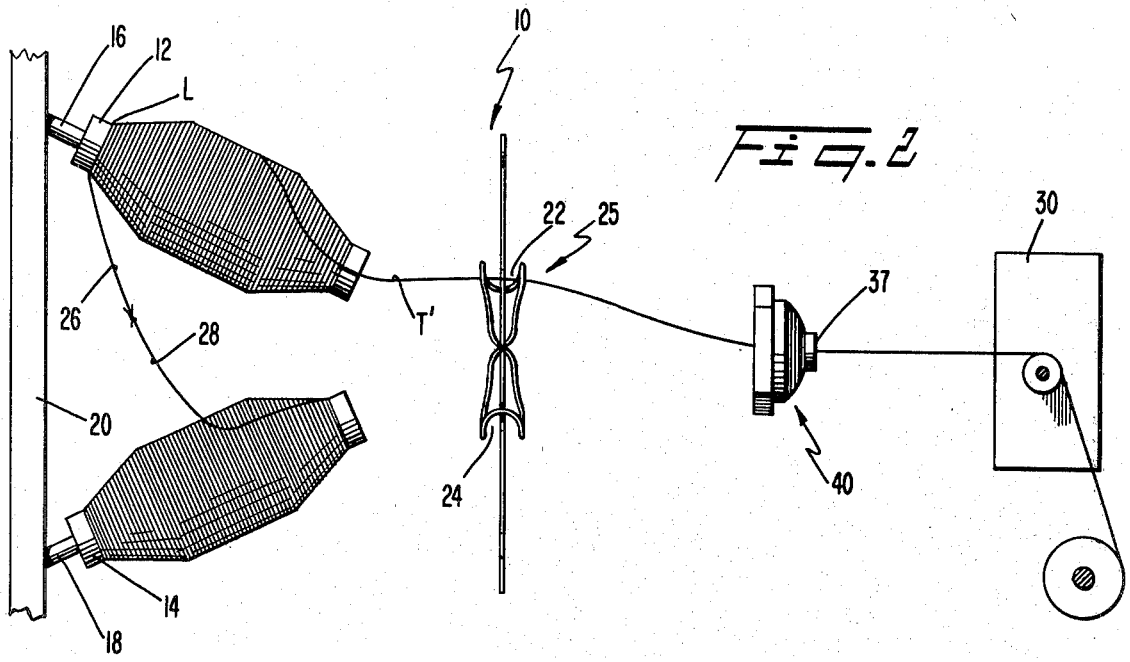
FIG. 2 is a schematic view of the horizontal multiple package thread transfer alignment guide system of the present invention.

For the purpose of reducing and controlling tension in thread T, a multiple package thread transfer alignment guide system 10 according to the present invention is provided, as shown in FIG. 2. Guide system 10 includes a package arrangement wherein adjacent first and second thread supply packages 12, 14 are substantially horizontally positioned upon respective elongated shafts 16, 18. Shafts 16, 18 are part of vertically disposed creel 20, such that the longitudinal feed axis from each supply package is directed toward respective first and second eyelet openings 22, 24 of thread transfer alignment guide 25. Each supply package 12, 14 contains a full supply of thread, wherein the transfer tail 26 of thread stored on the first supply package 12 is spliced with the leading end 28 of thread stored on the second supply package 14 to enable continuous feeding of yarn into processing panel 30. Splicing of thread stored on packages 12, 14 may be accomplished with conventional transfer knots or with the method and apparatus disclosed in Lenoir et al. U.S. Pat. No. 3,984,971, issued Oct. 12, 1976 and assigned to the assignee of the present invention.

As shown in FIG. 2, thread T' from first supply package 12 is successively threaded through eyelet opening 22 in alignment guide 25 and opening 37 in trumpet guide 40. Alignment guide 25 successfully controls the ballooning effect of thread rapidly spinning off of the supply package 12 to minimize tension fluctuation and properly align the thread with the trumpet guide 40.

As shown in FIGS. 3 and 4, alignment guide 25 is formed of a continuous rod R, such as a rigid wire, preferably approximately 3/32 inches in diameter with a preferred R.M.S. value in the range between 40 to 60, and a hard chrome or ceramic oxide finish for smoothness. Alignment guide 25 includes oppositely disposed substantially straight portions 42, 44 outwardly terminating in attachment openings 45*a*, 45*b* for attaching alignment guide 25 to a support structure (not shown) with bolts or similar means. Between straight portions 42, 44 and center point A of guide 25, the rod has two curved portions in overlapping and spaced relation (FIG. 4). The curved portions are shaped to form respective first and second sets of eyelets 46, 48, in turn defining the eyelet openings 22, 24, respectively.

Eyelet sets 46, 48 include coaxially located loops 46*a–b*, 48*a–b*, respectively, in the rod R. As shown in FIG. 4, each of the loops 46*a–b*, 48*a–b* projects outwardly and parallel to each other from respective straight portions 42, 44 and is partially open in the direction facing the center A.

As further shown in FIG. 4, extension portions 42*a*, 44*a* of respective straight portions 42, 44 are designed to close off the open portion of the eyelets. The eyelet openings 22, 24, thus defined, have a diameter of approximately 5 millimeters.

As shown in FIG. 3, each of extension portions 42*a*, 44*a* actually extend between respective eyelet loops 46*a–b*, 48*a–b* in a direction coplanar with openings 22, 24 and are longitudinally spaced apart from the loops (in the direction of the movement of the thread T', note arrow B). With this design, thread T' may pass through eyelet openings 22, 24 and be laterally confined. In the system, alignment guide 25 is positioned so that eyelet openings 22, 24 are respectively aligned with the yarn feed axis of first and second supply packages 12, 14.

Curved return portions 47, 49 are provided respectively between eyelets 46, 48 and center point A. The extension portions 44*a* and 42*a* bend into overlapping relationship with the return portions 47, 49, respectively (see FIG. 4). These overlapping portions are longitudinally spaced apart from each other a distance of approximately 3 millimeters (see pin FIG. 4). The path inlet openings 50, 51 (defined by axis C in FIG. 4*a*) communicate respectively with eyelet openings 22, 24. The overlapping portions overlap in a direction substantially coplanar with the eyelet openings 22, 24. Preferably, the overlap distance, denoted by the reference letter W (FIG. 4), is dimensioned within a range of between 3.5 to 4.0 millimeters. This width W enables thread T to pass through the path inlet openings 50, 51 for transferring the thread path to or from eyelet openings 22, 24; yet operates to laterally confine the thread within eyelet opening 22 as the thread T' feeds from the packages 12, 14.

In addition, it is desirable to form curved return portions 47, 49 at an angle of approximately 60° with the axis C (see FIG. 4*a*) of path inlet openings 50, 51, and extension portions 44, 42 at a complementary angle of 30° toward respective eyelet openings 22, 24. These particular angles aid in confining the thread within the eyelets until the transfer conditions occur.

The full advantage of this invention may best be realized by following the operations involved in feeding thread T' from first supply package 12 through eyelet opening 22 to processing panel 30 and thereafter transferring the thread path from eyelet opening 22 to opening 24 when thread supply from package 12 is exhausted. As shown in FIG. 2, the longitudinal thread feed axis of supply package 12 is substantially aligned with eyelet opening 22 of alignment guide 25. Thread T' passes through eyelet opening 22 and opening 37 of trumpet guide 40 for processing in panel 30. As thread spins off first supply package 12 in rapid spinning movement, the above discussed ballooning effect is minimized by guide 25 being relatively close to the supply packages 12, 14 (approximately 3 to 4 inches from the packages). Such close positioning is possible with guide 25, since the feature of providing dual eyelet openings 22, 24 respectively aligned with the thread feed axis of respective supply packages 12, 14 minimizes both the thread feed angle and excessive tension which might otherwise result at a greater feed angle. As the supply of thread from package 12 runs out, there is a momentary loss of balloon tension on the thread as the last wrap is removed from package 12 at point L. Simultaneously, as the last wrap of thread moves in the direction of supply package 14 there is the growing effect of tension along the new thread path vector angle (an angle essentially formed between imaginary lines extending from the longitudinal axis of second supply package 14 and eyelet opening 22, and eyelet opening 37 of trumpet guide 40). The momentary loss of balloon tension together with the new vector angle causes the relaxed thread to slip into path inlet opening 50 adjacent eyelet opening 22 and slide through the tortuous transfer path P (approximately 50 millimeters long) into eyelet opening 24. Thereafter, thread T realigns itself into a new thread path between second supply package 14 and eyelet opening 24.

The feature of providing two eyelet openings interconnected by a tortuous path reduces the tension exerted upon the thread to within 7 to 9 grams, thereby minimizing the possibility of thread breakage. This avoids the breakage problem found in the prior art, and the resultant loss due to having to manually restring the thread each time the break occurs.

FIGS. 5–7 illustrate a different embodiment of thread transfer alignment guide 25, denoted by the reference numeral 25*a*, wherein parts similar to those found in alignment guide 25 are labeled with like numbers and the suffix "a". Alignment guide device 25*a* can be two identical parts 62, 64. Alternatively, guide 25*a* could be one integral piece. Grooves 66 peripherally extend around each insert for retention within a rectangular frame 70 (FIG. 6) for fixedly mounting in alignment with supply packages 12, 14. Eyelet openings 22*a*, 24*a* are formed respectively in the inserts 62, 64.

Path inlet opening portions 50*a*, 51*a* are formed respectively adjacent eyelet openings 22*a*, 24*a*. As shown in FIG. 6, path inlet opening portion 50*a* includes arcuately shaped first portion 72 having channel walls 74, 74' defining a V-shaped channel. An arcuate opposing portion 75 projects into the channel and is spaced apart from channel walls 74, 74' to define a thread transfer path between the overlapping first and second portions connecting eyelet opening 22*a* to a central path portion 76. Similar overlapping portions are formed in insert 64 to complete the tortuous path between eyelet openings 22*a*, 24*a* of the assembled structure.

The overlapping width W of the two inlet openings 50*a*, 51*a* are dimensioned similar to the width of inlet openings 50, 51 in guide device 25. Inserts 62, 64 are preferably ceramic material, more preferably molded ceramic.

The transfer of a thread T' between the openings 22*a*, 24*a* occurs in the same efficient, low tension way, as described above. The thread T' slips out of eyelet opening 22*a*, through the path inlet opening 50*a*, crosses the central path portion 76 and then slips through path inlet opening 51*a* and into eyelet opening 24*a*. Due to the low friction ceramic faces of the channel walls 74, 74' and the arcuate opposing portion 75 and the unique geometry thereof, the tension of the thread T' advantageously remains in the desired 7–9 gram range.

It is understood that this thread transfer alignment guide 25, 25*a* is reversible as shown and described. When thread T' is pulled off over the end of the supply packages 12, 14, the resulting balloon defines either a clockwise generated envelope or a counterclockwise generated envelope. A clockwise generated balloon, in order to properly guide and transfer, must enter the thread transfer alignment guide on the side identified as "Z". Conversely, a counterclockwise balloon guides and transfers properly only when entering the side identified as "S".

The reason this matching is necessary is that the ballooning thread T' should wipe the eyelet in the direction going away from the overlapping opening (note arrow C in FIG. 5). As long as thread is coming from the supply packages 12, 14, the balloon generation prevents the thread from entering the opening into the tortuous path. However, when the supply package runs out, balloon generation ceases. The slack thread at the splice causes no balloon generation; without balloon this slack, coupled with the new vector angle, allows the relaxed thread to back-slip into the path inlet opening for transfer as described earlier.

The foregoing description of a preferred embodiment of the present invention has been presented for purposes of illustration and description. It is not intended to be exhaustive or to limit the invention to the precise form disclosed, and obviously many modifications and variations are possible, in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A thread transfer alignment guide device for maintaining continuous thread feed from a first supply package carrying thread interconnected with a thread end of an adjacent supply package, the thread being properly aligned and appropriately tensioned for processing, comprising:

(a) a plurality of laterally spaced eyelets having openings substantially facing the supply packages for receiving and guiding thread between the supply packages and a receiving location; and (b) tortuous path means interconnecting the eyelet openings, said tortuous path means formed to laterally confine a thread within an eyelet opening but operative to enable the thread to enter and pass through a thread transfer path into the adjacent eyelet opening when the thread substantially entirely unwinds from the first supply package for switching to the adjacent supply package.

2. A thread alignment guide device according to claim 1, wherein said tortuous path means includes first and second portions spaced apart from each other in overlapping relation to define a path inlet opening communicating with each of said eyelets, said portions overlapping a predetermined distance in a direction substantially coplanar with the eyelet openings.

3. A thread alignment guide device according to claim 2, wherein said first and second portions form a portion of each eyelet opening.

4. A thread alignment guide device according to claim 3, wherein said first portion forms an angle of substantially 60° with a longitudinal axis of said path inlet opening, and the second portion forms a complementary angle of substantially 30° with the axis toward the eyelet opening.

5. A thread alignment guide device according to claim 2 or 3, wherein said first and second portions overlap a predetermined distance in the range of approximately 3.5 to 4.0 millimeters.

6. A thread alignment guide device according to claim 2, wherein said first and second portions are spaced apart from each other a distance of approximately 3 millimeters.

7. A thread alignment guide device according to claim 1, wherein said eyelet opening has a diameter of approximately 5 millimeters.

8. A thread alignment guide device according to claim 1, wherein said eyelets are spaced apart from each other by said tortuous path means having a length of approximately 50 millimeters.

9. A thread alignment guide device according to claim 2 or 3, wherein said eyelets are formed of a continuous rod shaped to define first and second sets of eyelets and the tortuous path means separating said eyelets, wherein each of said first and second eyelet sets include two corresponding coaxially located eyelets, the first portion of the path inlet opening includes two corresponding arcuately shaped rod portions spaced apart from each other, and said second portion includes an opposing arcuately shaped rod portion intermediate and spaced apart from the first portions in overlapping relation, thereby defining said thread transfer path between said eyelet openings.

10. A thread alignment guide device according to claim 2 or 3, wherein each of said eyelets is formed from a material of unitary structure shaped to define the respective first and second eyelets and the tortuous path means connecting said eyelets, wherein the first portion of the path inlet opening includes two corresponding arcuately shaped portions defining a channel having a channel axis leading into the eyelet opening, and the second portion includes an opposing arcuately shaped portion projecting into the channel and spaced apart from the first portions, thereby defining said thread transfer path to said eyelet opening.

11. A multiple package thread transfer alignment guide system comprising, in combination:

(a) first and second adjacent supply packages having a horizontally disposed longitudinal feed axis, said supply packages carrying thread spliced together, thereby enabling thread feed transfer when the thread substantially entirely unwinds from the first supply package for switching to the full supply second package;

(b) a thread transfer alignment guide including first and second laterally spaced eyelets having openings substantially facing the first and second supply packages respectively for receiving and guiding thread between the supply packages and a receiving location, and tortuous path means interconnecting the eyelet openings, said tortuous path means formed to laterally confine a thread within one of said eyelet openings but operative to enable the thread to enter and pass through a thread transfer path into the adjacent eyelet opening when the thread substantially entirely unwinds from the first supply package for switching to the second supply package; and (c) guide means for receiving and directing thread from said thread transfer alignment guide device to a processing location.

* * * * *